United States Patent [19]

Summey

[11] 3,958,351

[45] May 25, 1976

[54] MODULAR SIGN SUPPORT ASSEMBLY

[76] Inventor: Mike Summey, 514 Rhododendron Ave., Black Mountain, N.C. 28711

[22] Filed: Nov. 25, 1974

[21] Appl. No.: 526,791

[52] U.S. Cl. ..... 40/145 R; 40/125 H; 211/107; 248/221 A; 248/230

[51] Int. Cl.[2] ..... G09F 7/18

[58] Field of Search ..... 40/145 R, 145 A, 125 H, 40/125 N, 125 K, 125 R, 131 R; 248/230, 221, 43, 226 D, 226 C; 211/107

[56] References Cited

UNITED STATES PATENTS

| | | | |
|---|---|---|---|
| 2,960,784 | 11/1960 | Frey et al. | 40/145 R X |
| 3,120,069 | 2/1964 | Pfaff et al. | 40/145 R X |
| 3,199,815 | 8/1965 | Martinkovic et al. | 248/221 X |
| 3,612,460 | 10/1971 | Smith | 248/221 |
| 3,776,498 | 12/1973 | Peters et al. | 248/221 |

*Primary Examiner*—Louis G. Mancene
*Assistant Examiner*—John F. Pitrelli
*Attorney, Agent, or Firm*—Mills and Coats

[57] ABSTRACT

The present invention relates to a modular sign support assembly wherein duplicate units of the sign support assembly may be integrated to form a sign support structure that supports one or more signs in any number of configurations or orientations.

Each sign support assembly includes a base support member that is adapted to be secured adjacent an upright pole and further includes a cantilever beam having a sign mounting frame structure secured thereto and adapted to receive and support at least one sign.

4 Claims, 5 Drawing Figures

MODULAR SIGN SUPPORT ASSEMBLY

The present invention relates to sign supporting structures, and more particularly to sign supporting structures of the type designed to support a plurality of individual signs from a single upright pole.

BACKGROUND OF THE INVENTION

Outdoor advertising has in recent years become a very popular medium for advertising. For the most part, at least, outdoor advertising entails the erection of signs or bulletins in places where public exposure is possible, usually adjacent highways and streets in view of the motoring traffic.

Conventional sign support structures of today are of the upright type and are designed to support one or more signs that generally face the same direction. Such sign structures are relatively expensive in term of their utility since the number of supported signs are limited, and further since such structures are not adapted to support signs at various angles. In addition, adding, removing or changing signs on conventional sign structures becomes quite expensive in that substantial time and labor is required, and in some cases, sophisticated equipment is needed to make such changes.

Finally, one other principal disadvantage with conventional sign support structures of today is that to a great extent they are all custom built for one single application and cannot be easily and conveniently dismantled and used in other applications or integrated to form a complex sign support structure.

SUMMARY OF THE INVENTION

The modular sign support assembly of the present invention presents a new and useful sign support unit that can be integrated into numerous final designs to form sign support structures where the signs supported thereby are disposed in numerous configuration and orientations. In addition, each sign support unit assembly is particularly adapted to be used in conjunction with other such unit assemblies to form an integrated sign support structure, and furthermore, each sign support unit assembly is interchangeable with other such unit assemblies and consequently, this enables sign support structures comprised of such units to be easily and conveniently modified.

Of particular significance, is the fact that such sign support unit assemblies are adapted to be supported about an upright pole and may be supported thereby at various positions and angles relative to other such sign support units.

Each sign support unit assembly comprises a base support member adapted to be secured adjacent a circumferential portion of an upright pole and held securedly adjacent thereto by connecting means which typically include a series of bolts connected between the pole and the base support structure. Extending from the base support structure is a cantilever beam means which has secured thereto a sign mounting frame structure adapted to receive and support at least one sign. Therefore, it is appreciated that a sign supported by the sign supporting frame structure is held outwardly of the upright pole which is normally anchored in the ground. In use, the various sign support unit assemblies may be both circumferentially and vertically aligned with respect to the major pole support, and therefore it follows that the integrated sign support structure may support any number of signs typically ranging from one to eight.

It is, therefore, an object of the present invention to provide a modular sign support assembly that is adapted to be integrated into a system of other such modular sign support unit assemblies to form an integrated sign support structure.

A further object of the present invention is to provide a modular sign support structure that can be interchanged with other such unit assemblies to modify and existing integrated sign structure.

Still a further object of the present invention resides in the provision of a modular sign support unit assembly that is adapted to be supported at various angles and locations on an upright support pole in order that signs may be displayed at various angles and positions thereon, thereby giving rise to a sign support structure that can be utilized to support a plurality of signs that can be viewed from more than one direction.

A further object of the present invention is to provide a modular sign support unit assembly that is relatively inexpensive and easy to work with and which is easy to install and maintain.

Other objects and advantages of the present invention will become apparent from a study of the following description and the accompanying drawings which are merely illustrative of the present invention.

DESCRIPTION OF THE PREFERRED EMBODIMENT

Figure 1:
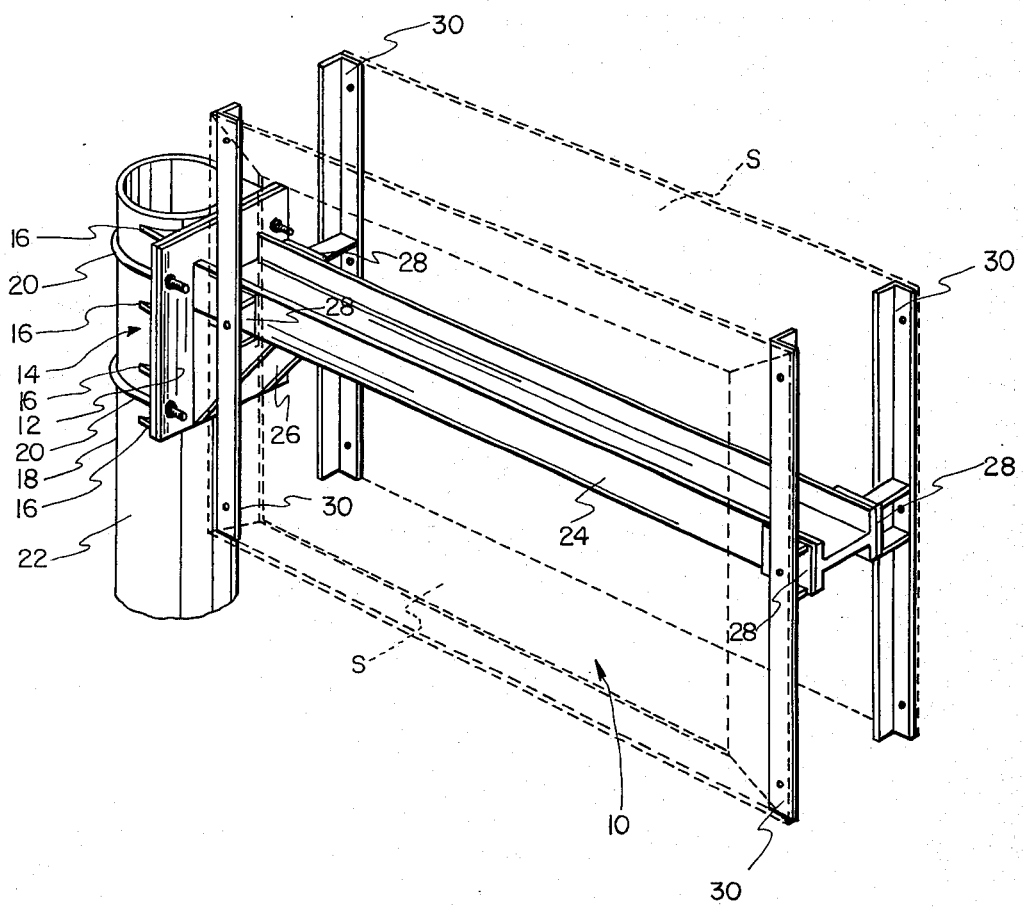
FIG. 1 is a perspective view of the modular sign support assembly of the present invention.

With further reference to the drawings, particularly FIG. 1, the modular sign support assembly unit of the present invention is shown therein and indicated generally by the numeral 10. Viewing the sign support assembly 10 in greater detail, it is seen that the same basically comprises a base support member 12 adapted to be securedly held closely adjacent an upright support pole 22. Support member 12 is shown as being of a planar construction including two generally flat plates secured together by bolts or other suitable means. However, it will be appreciated by those skilled in the art that such base support member could very well be of some other type construction such as angle iron or the like.

Figure 3:
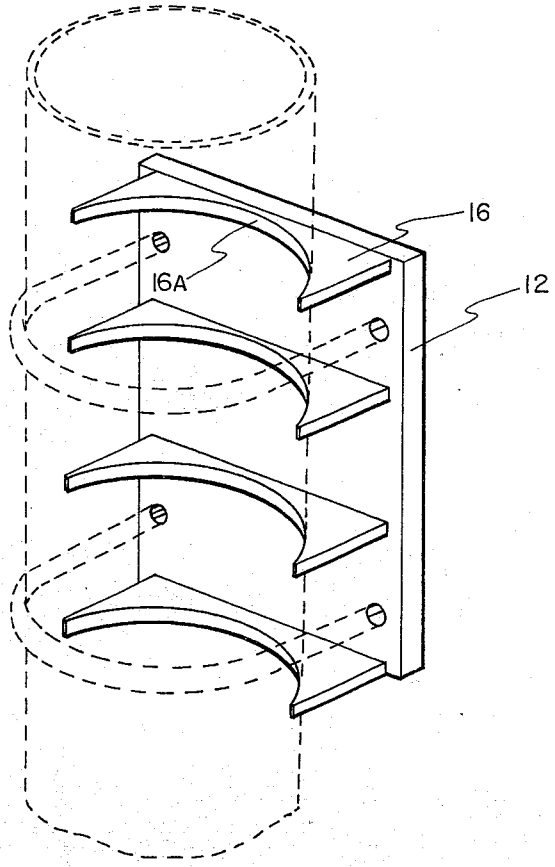
FIG. 3 is a fragmentary view illustrating the series of vertical ribs disposed on the back of the base support unit of the modular sign support assembly.

Disposed upon the back side of said base support member 12 is a plurality of vertically spaced ribs 16, the ribs also being referred to as fitting means since they serve to fit the base support member 12 to the circumferential portions of the pole 22 in order that the base support member can be held in a stable relationship relative thereto. As best seen in FIG. 3, the ribs 16 include an arcuate shape back edge **16*a* that generally conform to the outer circumferential shape of the pole 22. This enables the base support member 12 to be firmly held closely adjacent the pole 22** in a stable and firm relationship.

Connecting means 18 is provided for stationing said base support member 12 to the pole 22. As shown in the case of the first species, FIG. 1, the connecting means 18 is in the form of a pair of verically spaced U-bolts 20 that encompass a substantial circumferential portion of the pole 22 and extends through the base support member 12 where the two terminal ends thereof are threaded to receive nuts. Consequently, the tightening of the nuts on the terminal ends of the U-shaped bolts 20 results in the base support member 12 being snugly drawn adjacent the pole 22.

Extending from the base support member 12 is a cantilever beam means 24, the cantilever beam means including laterally spaced brackets 28 secured on both sides thereof. The cantilever beam means 24 partially supported by a brace means 26 that extends diagonally between the beam and the base support member 12.

Secured to the cantilever beam means 24 is a sign mounting frame structure. This sign mounting frame structure includes a pair of vertical sign support members 30, the vertical sign support members 30 being disposed in lateral spaced apart relationship and secured to respective brackets 28 by U-bolts or the like. In the case of the first species, shown in FIG. 1, the modular sign mounting unit assembly 10 is particularly adapted to support a pair of signs in back-to-back relationship. Accordingly, the cantilever beam 24 includes a second pair of vertical members 30 secured to respective brackets 28 along the other side of the beam. From a review of FIG. 1, it is thusly seen that a pair of signs could be supported in back-to-back fashion.

Figure 2:
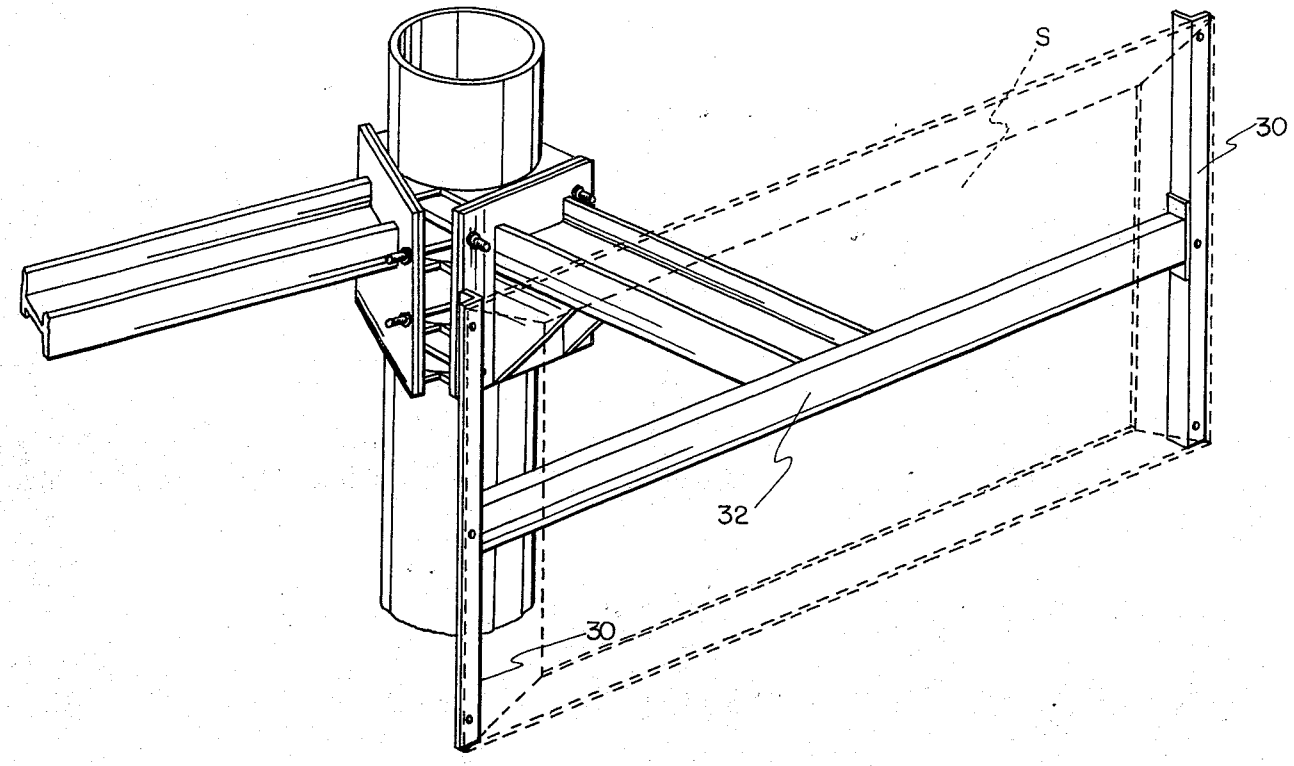
FIG. 2 is a perspective view of an alternate or second species of the modular sign support assembly of the present invention.

Turning to FIG. 2, a second species of the modular sign mounting unit assembly 10 is shown therein. The structure here is basically the same as discussed with the first species, with the exception that the sign mounting frame structure is disposed at an angle perpendicular to the axis of the cantilever beam 24. More particularly, the sign mounting frame structure includes a cross member 22 secured by bolts or other suitable securing means to the outer end of the cantilever beam, the point of securement being generally about the mid-point of the cross member 32. In the case of the second species, the vertical members 30 are secured at opposed ends of the cross member 32 and are adapted to receive and support a sign, indicated by S as in FIG. 1.

Figure 4:
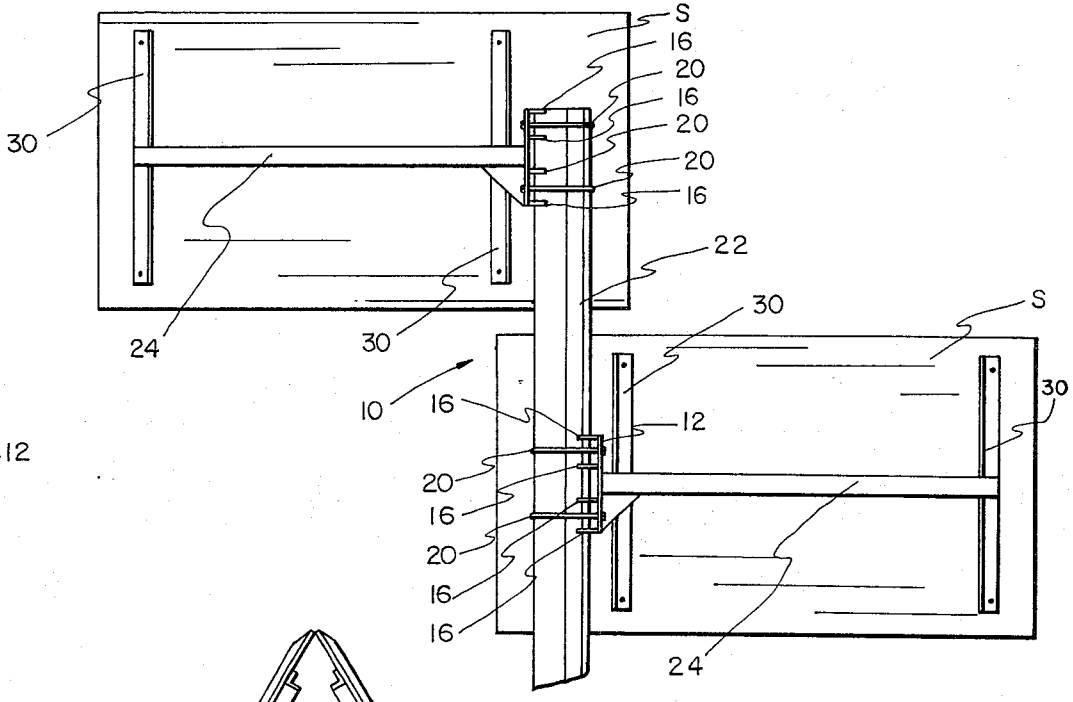
FIGS. 4–5 are views of the integrated sign support structures each of which utilize a series of the modular sign support assemblies of the present invention.
Figure 5:
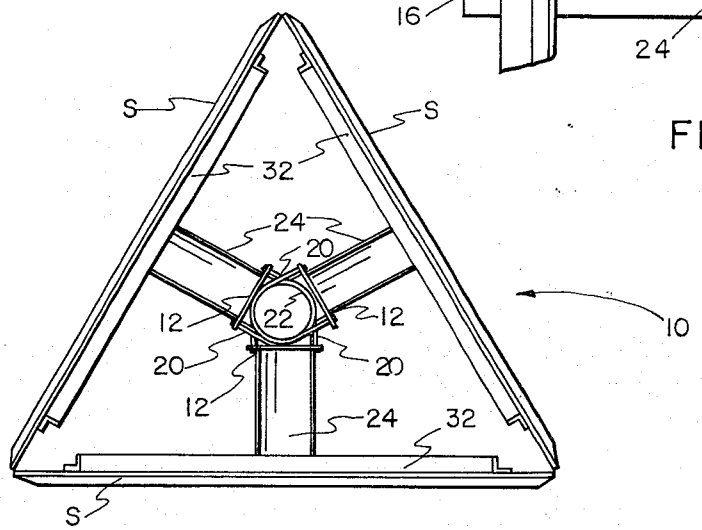

By using the modular sign support unit assembly 10, sign support structures can be formed by integrating such units to support a plurality of signs to support a plurality of signs at various positions and orientations about the pole 22. In this regard, it is seen that a plurality of the support unit assemblies 10 of FIG. 1 can be placed about a pole 22 in various positions and orientations. For example, a plurality of the sign support units 10 could be secured in vertical alignment with the individual units being slightly spaced apart, or the individual units can be circumferentially spaced while being in horizontal alignment. Still another example would be that the units could be both circumferentially spaced and vertically spaced. Specifically illustrated in FIGS. 4 and 5 are two integrated sign support structures that utilize individual modular sign support units 10. These integrated sign structures have signs circumferentially designed around the pole 22 in numbers of three and four.

In addition, in either case, this circumferentially alignment can be duplicated above or below the first group of signs to form a sign structure that would support either 6 or 8 individual signs. This is particularly advantageous in locations where all of the signs would be exposed to the public.

From the foregoing specification, it is apparent that the modular sign support unit assembly 10 of the present invention enables a sign structure to be formed by integrating the individual units 10 together to form a particular design, configuration, or orientation of the plurality of signs to be supported. In addition, by the very modular nature of the sign support unit assembly, it follows that the configuration or orientation of the signs of the sign support structure can be easily and conveniently modified and changed. Also, modular unit assembly 10 of the present invention enables such to be readily exchanged with other such unit assemblies already in operation.

The terms "upper", "lower", "forward", "rearward", etc., have been used herein merely for the convenience of the foregoing specification and in the appended claims to describe the MODULAR SIGN SUPPORT ASSEMBLY and its parts as oriented in the drawings. It is to be understood, however, that these terms are in no way limiting to the invention since the MODULAR SIGN SUPPORT ASSEMBLY may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. A modular sign support assembly for supporting sign means for an upright generally cylindrical shaped pole, said modular sign supporting assembly comprising: a base support unit including a planar plate structure; fitting means secured to the back of said base support unit for stablizing said base support unit relative to said pole, said fitting means including a generally arcuate shaped back portion having a plurality of vertically spaced ribs, each rib being fixed to the back of said base support unit and having an arcuate shaped back edge formed thereon which normally engages the circumference of said pole when said base support unit is disposed and held adjacent thereto, whereby said fitting means enables said base support unit to be held in a stable relationship adjacent said upright pole; connecting means secured to said base support unit and extending therefrom for securely stationing said base support unit to said pole; cantilever beam means fixed to said base support unit and extending therefrom; brace means extending between said planar plate support and said cantilever beam means for supporting said cantilever beam means relatively to said planar plate structure; and mounting frame means fixed to said cantilever beam means for receiving sign means and supporting the same outwardly of said upright pole, said mounting frame means including at least two vertical support members operatively supported by said cantilever beam means on each side thereof and extending in generally parallel relationship with the axis of said pole, respective vertical members on each of said cantilever beam means being laterally spaced and adapted to receive and support at least one sign.

2. The modular sign support assembly of claim 1 wherein said connecting means for securedly stationing said base support unit to said pole includes a plurality of bolts adapted to extend through said base support unit and to engage said pole for holding said base support unit adjacent thereto.

3. The modular sign support assembly of claim 1 wherein said connecting means for securedly stationing said base support unit to said pole includes a plurality of U-bolts, each U-bolt being adapted to encompass said pole and to extend through said planar plate support structure of said base support unit where the terminal ends thereof are threaded and adapted to receive nuts, whereby said planar plate structure may be securedly stationed adjacent said pole by tightening the nuts on the threaded terminal ends of said U-bolts.

4. The modular sign support assembly of claim 3 including a plurality of bracket members secured to said cantilever beam means for supporting said vertical sign support members adjacent said cantilever beam means and further including bolt means adapted to connect each of said bracket members to said vertical sign mounting member.

* * * * *